US009414724B2

(12) United States Patent
Vallance et al.

(10) Patent No.: US 9,414,724 B2
(45) Date of Patent: Aug. 16, 2016

(54) DAMPED HINGE ASSEMBLIES

(75) Inventors: William Earnest Taylor Vallance, Bucks (GB); David Pecar, Koper (SL)

(73) Assignee: Titus International Ltd., Middlesex (GB)

( * ) Notice: Subject to any disclaimer, the term of this patent is extended or adjusted under 35 U.S.C. 154(b) by 0 days.

(21) Appl. No.: 13/817,566

(22) PCT Filed: Aug. 19, 2011

(86) PCT No.: PCT/GB2011/001249

§ 371 (c)(1), (2), (4) Date: May 13, 2013

(87) PCT Pub. No.: WO2012/022946

PCT Pub. Date: Feb. 23, 2012

(65) Prior Publication Data

US 2013/0283568 A1 Oct. 31, 2013

(30) Foreign Application Priority Data

Aug. 19, 2010 (GB) ..... 1013919.4

(51) Int. Cl.
*A47K 13/12* (2006.01)
*E05F 3/20* (2006.01)

(52) U.S. Cl.
CPC . *A47K 13/12* (2013.01); *E05F 3/20* (2013.01); *E05Y 2900/614* (2013.01); *Y10T 16/2771* (2015.01); *Y10T 16/538* (2015.01)

(58) Field of Classification Search
CPC ..... Y10T 16/5387; Y10T 16/540255; Y10T 16/2771; Y10T 16/304; Y10T 16/61; Y10T 16/538; E05Y 2900/614; A47K 13/12; A47K 13/10; A47K 13/105; E05F 3/20; E05F 1/1008
USPC ..... 16/303, 330, 54, 50, 82, 277; 4/236, 4/240, 248; 188/322.5
See application file for complete search history.

(56) References Cited

U.S. PATENT DOCUMENTS 1,993,625 A * 3/1935 Riemer ..... A47K 13/12 16/50
2,474,164 A * 6/1949 Riemer ..... A47K 13/12 16/374
5,109,571 A 5/1992 Ohshima et al.
5,222,260 A * 6/1993 Piper ..... A47K 13/10 16/303
5,267,356 A * 12/1993 Gideon ..... A47K 13/10 16/69
5,279,000 A * 1/1994 Mercier ..... A47K 13/10 4/240
5,604,936 A * 2/1997 Mausolf ..... A47K 13/10 188/302

(Continued)

FOREIGN PATENT DOCUMENTS

DE 3722114 A1 1/1988

*Primary Examiner* — William Miller
(74) *Attorney, Agent, or Firm* — Alan D. Kamrath; Kamrath IP Lawfirm, P.A.

(57) ABSTRACT

A damped hinge assembly mounts a first member (12, 13) for pivotal movement relative to a second member (14) about an axis of rotation (20). The assembly includes a linear damper (17), which is mounted with its longitudinal axis parallel to the hinge axis, and a cam drive arrangement (21*a*, 21*b*, 30*a*, 30*b*) for converting the pivotal movement of the first member in at least one direction of rotation into linear displacement of the damper. This causes the damper to produce a damped resistive force to counter the pivotal movement of the first member. The longitudinal axis of the damper is arranged to be coincident with the hinge axis.

23 Claims, 6 Drawing Sheets

(56) References Cited

U.S. PATENT DOCUMENTS

| | | | | |
|---|---|---|---|---|
| 5,906,010 | A * | 5/1999 | Suzuki | 4/236 |
| 5,996,132 | A | 12/1999 | Sorimachi | |
| 6,052,869 | A * | 4/2000 | Suzuki | 16/341 |
| 6,178,597 | B1 * | 1/2001 | Suzuki et al. | 16/330 |
| 6,336,252 | B1 * | 1/2002 | Bando | 16/307 |
| 6,389,611 | B2 * | 5/2002 | Fujita | 4/236 |
| 6,393,624 | B1 * | 5/2002 | Iwashita | 4/248 |
| 8,307,503 | B1 * | 11/2012 | Burger | 16/277 |
| 8,439,172 | B2 * | 5/2013 | Lee | 188/290 |
| 8,516,657 | B2 * | 8/2013 | Yoshida | 16/50 |
| 2002/0062518 | A1 * | 5/2002 | Hellwig | A47K 13/12 4/240 |
| 2003/0009819 | A1 * | 1/2003 | Mizuno | F16F 9/14 4/248 |
| 2005/0246863 | A1 | 11/2005 | Chesworth et al. | |
| 2005/0269176 | A1 * | 12/2005 | Tomiji | F16F 9/3405 188/284 |
| 2006/0230573 | A1 | 10/2006 | Kao | |
| 2010/0011493 | A1 * | 1/2010 | Wiig | A47K 13/10 4/246.1 |
| 2010/0102494 | A1 | 4/2010 | Duc et al. | |
| 2010/0199414 | A1 * | 8/2010 | Shannon | A47K 13/10 4/236 |

* cited by examiner

DAMPED HINGE ASSEMBLIES

This invention relates to damped hinge assemblies and more particularly, though not exclusively, to damped hinge assemblies for mounting elements such as lids, seats and doors.

The invention provides a damped hinge assembly for mounting a first member for pivotal movement relative to a second member about an axis of rotation. The assembly comprises a linear damper, means mounting the damper with its longitudinal axis parallel to the hinge axis, and camrning means for converting pivotal movement of the first member in at least one direction of rotation into linear displacement of the damper to cause the damper to produce a damped resistive force to counter said pivotal movement of the first member. The longitudinal axis of the damper is arranged to be coincident with the hinge axis.

Figure 1:
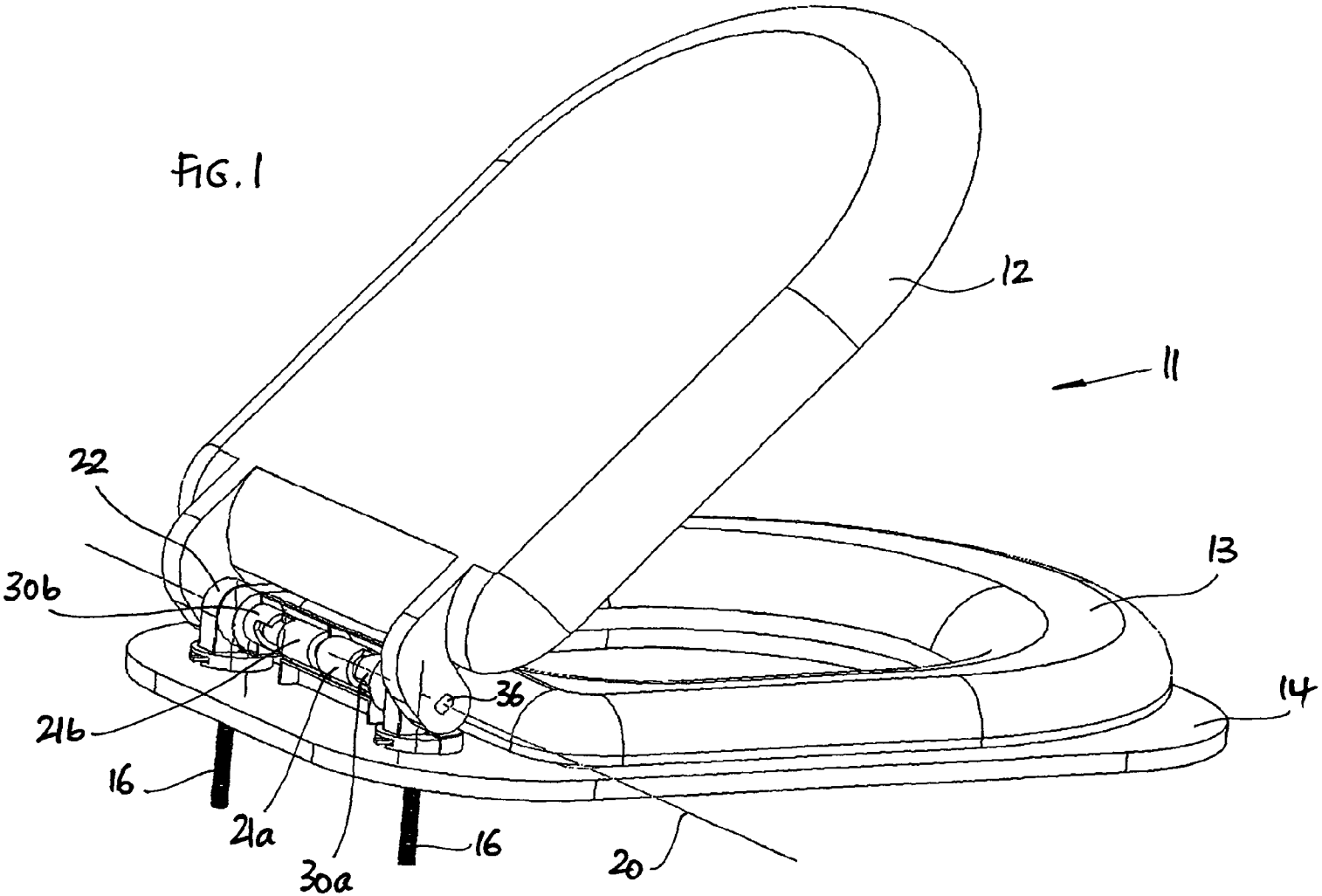
Figure 2:
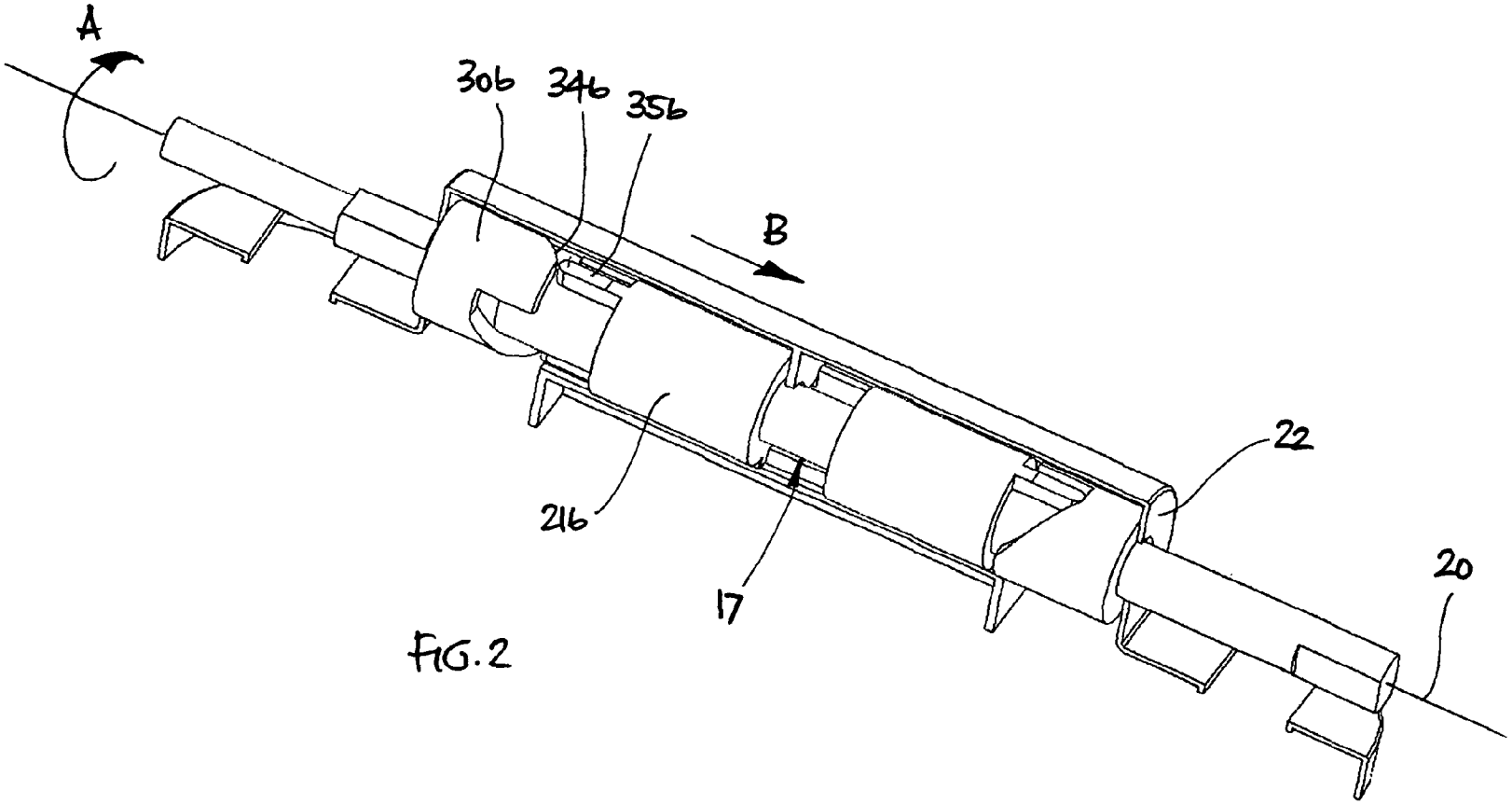
Figure 3:
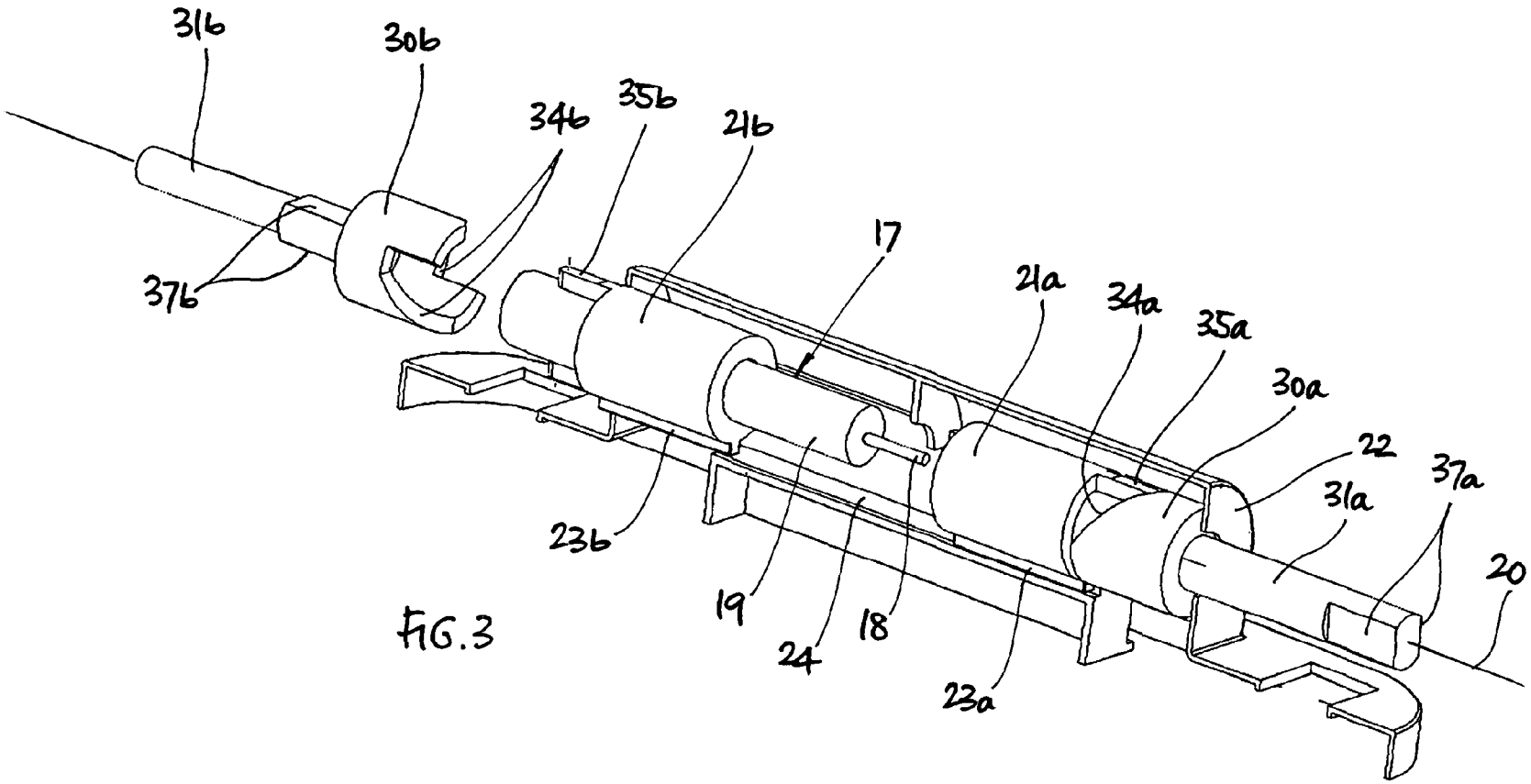
Figure 4:
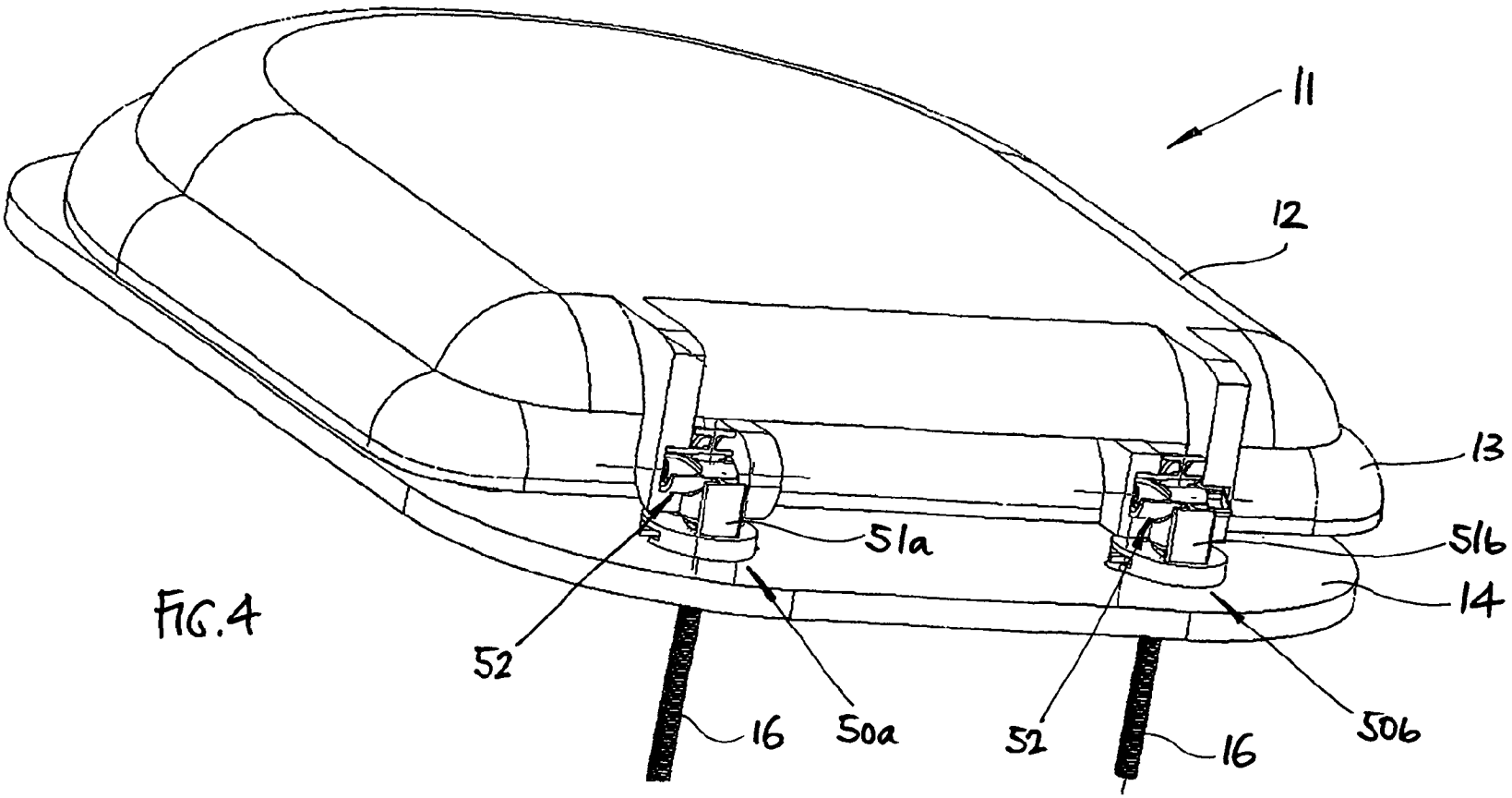
Figure 5:
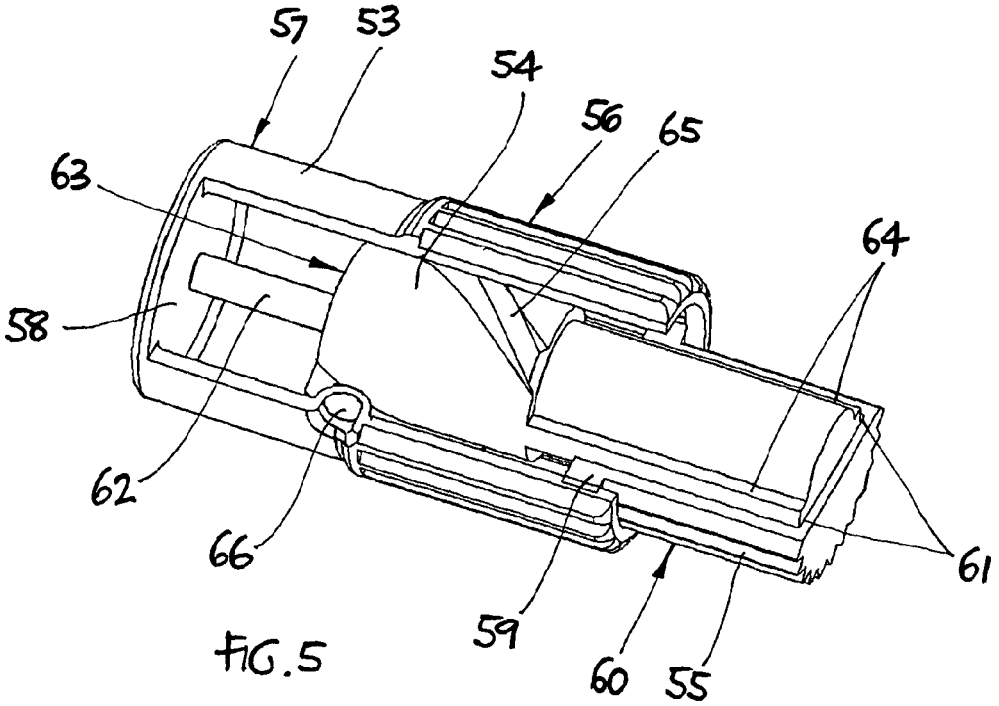
Figure 6:
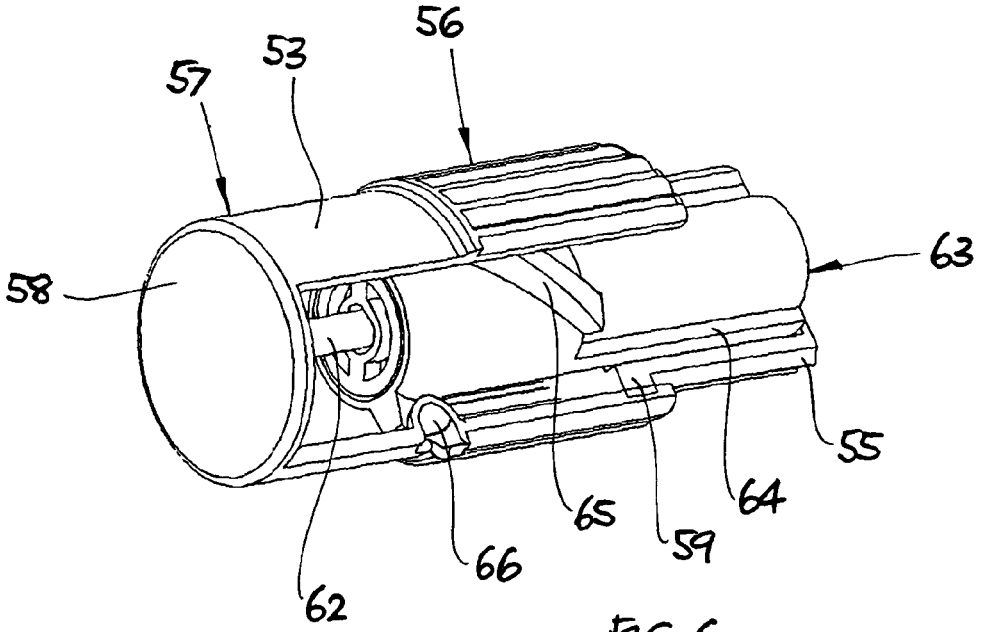
Figure 7:
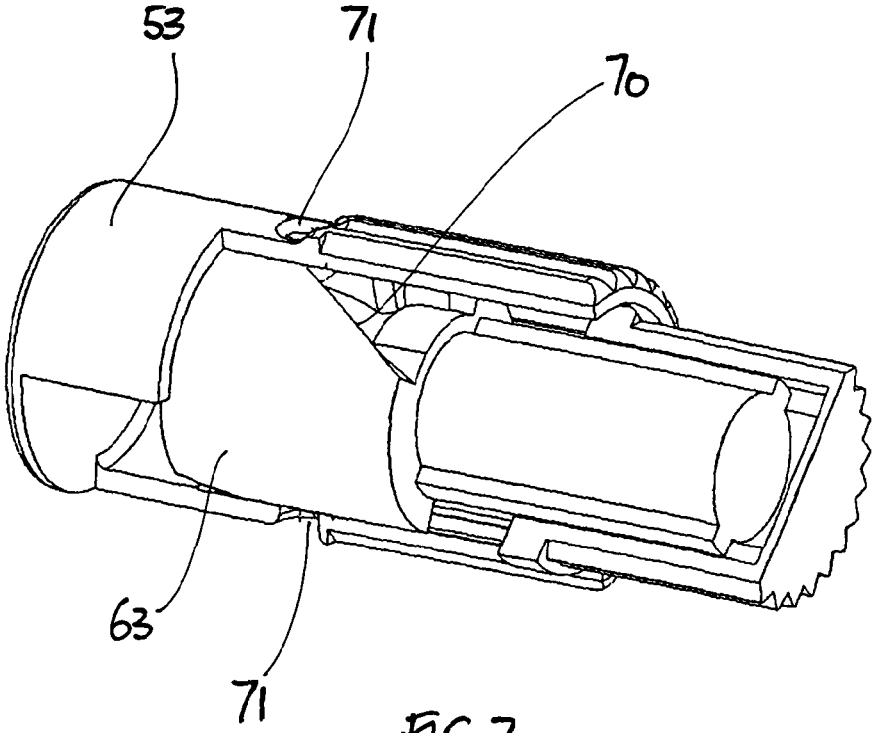

By way of example, embodiments of the invention will now be described with reference to the accompanying drawings, in which:

FIG. 1 shows a first form of a damped hinge assembly according to the invention (shown partly cut-away to reveal detail), FIG. 2 is a detail view of the drive mechanism of the assembly of FIG. 1, FIG. 3 is an exploded view of the FIG. 2 detail, FIG. 4 shows a second form of a damped hinge assembly according to the invention (shown partly cut-away to reveal detail), FIGS. 5 and 6 show in partly cut-away detail the damping unit of the assembly of FIG. 4, and FIG. 7 shows in partly cut-away detail an alternative form of a damping unit for the assembly of FIG. 4.

The damped hinge assembly seen in FIG. 1 is for use on a lavatory seat 11. The lavatory seat 11 comprises a lid member 12 and a seat member 13, both of which are pivotally mounted onto the lavatory 14 by a hinge mounted on a block 22 (shown partly cut away in the drawings). The block 22 is anchored to the lavatory 14 by the usual spaced apart threaded fasteners 16. The arrangement enables both the lid and seat members 12, 13 to be pivotable between a lower, generally horizontal position resting on the lavatory 14 and a raised position, generally slightly beyond vertical and resting against a cistern or wall or the like.

The assembly is arranged to provide a damped resistive force to counter the pivotal movement of both the lid and seat members 12, 13 as they move under gravity from their raised position to their lowered position. This is intended to avoid possible damage that could otherwise occur if the lid and/or seat members were accidentally allowed to fall freely onto the lavatory.

The assembly comprises a damper 17, which is conveniently located in the space between the hinge block mounting threaded fasteners 16. The damper 17 here is a linear damper of the piston and cylinder variety, with a piston (not shown) connected to a piston rod 18 and acting within a cylinder 19 on a damping medium (not shown) such as silicone (see FIG. 3). The damper 17 incorporates a spring (not shown) arranged to bias the piston rod 18 towards its extended position. The damper 17 is designed here to provide the damped resistive force to the lid and/or seat members 12, 13 in response to its axial compression. However, the damper 17 provides no damped resistance upon its axial extension.

As will be seen in the drawings, the damper 17 is mounted on the block 22 and arranged with its longitudinal axis coincident with the pivotal axis 20 of the assembly. The damper 17 is captured in this position between two spaced apart end caps

21*a*, 21*b*. Each end cap 21*a*, 21*b* is generally cylindrical and has an axially extending rib 23*a*, 23*b* which engages in a groove 24 in the block 22. The groove 24 extends parallel to the pivotal axis 20 of the assembly. The arrangement means that the two end caps 21*a*, 21*b* are both capable of linear movement parallel to the pivotal axis 20 of the assembly (both towards and away from each other), but are prevented from rotating relative to the block 22. Thus, movement of the end caps 21*a*, 21*b* towards each other will cause axial compression of the damper 17, whilst movement of the end caps 21*a*, 21*b* away from each other will allow axial extension of the damper, under the influence of its spring.

As will be seen in the drawings, the lid and seat members 12, 13 each have a respective driving element 30*a*, 30*b* associated therewith. Each driving element 30*a*, 30*b* is rotatably mounted on the assembly by a spindle 31*a*, 31*b* journalled in a bore in the block 22. The axis of rotation of the spindles 31*a*, 31*b* is coincident with the pivotal axis 20 of the assembly. Each driving element 30*a*, 30*b* is arranged to be keyed to its respective lid/seat member 12, 13 to rotate therewith. In the case of the lid member 12, for example, it can be seen in the drawings how the spindle 31*a* of its respective driving element 30*a* is provided with flats 37*a* and fits in a flatted hole 36 in the hinge part of the lid member. The arrangement means that whenever the lid member 12 is pivoted, the spindle 31*a* and hence its associateda driving element 30*a* will likewise be driven to rotate. In a similar manner, the spindle 31*b* is provided with flats 37*b* and fits in a flatted hole in the hinge part of the seat member 13, so that whenever the seat member is pivoted, the spindle 31*b* and hence its associated driving element 30*b* will likewise be driven to rotate.

Each driving element 30*a*, 30*b* has circumferentially extending ramped surfaces 34*a*, 34*b* on its axially inwardly facing end. For balance, the ramped surfaces are provided on their elements as diametrically opposed pairs, as can be seen in the case of the driving element 30*b* for the seat member in FIG. 3. Each of these ramped surfaces 34*a*, 34*b* is engaged by a respective nib 35*a*, 35*b* on the end caps 21*a*, 21*b* (again provided as diametrically opposed pairs). The nibs 35*a*, 35*b* will be biassed into engagement with their respective ramped surfaces 34*a*, 34*b* by the action of the spring in the damper 17. It will be understood that this arrangement means that when either of the driving elements 30*a*, 30*b* rotates, its ramped surface 34*a*, 34*b* will act on the respective nib 35*a*, 35*b* to cause longitudinal displacement of its respective end cap 21*a*, 21*b*. The ramped surfaces 34*a*, 34*b* and nibs 35*a*, 35*b* thus act in the manner of a cam and cam follower, translating rotational movement into linear movement. The rotational movement of the lid and/or seat members 12, 13 is thus translated by this motion converting mechanism into linear displacement (extension or compression) of the damper 17.

In FIG. 2, for example, the assembly is seen in its condition when the lid member is in its raised position, whilst the seat member is in its lower position. The driving element 30*b* associated with the seat member has been rotated in the direction of arrow A as the seat member has been lowered. This has driven its associated end cap 21*b* in the direction of arrow B by the caroming action of the ramped surface 34*b* on the nib 35*b*. Movement of the end cap 21*b* in this manner has caused compression of the damper 17, thereby imparting a damped resistive force to the lowering movement of the seat member.

It will be understood that the manner of engagement of the nibs 35*a*, 35*b* on their respective ramped surfaces 34*a*, 34*b* needs to be capable of sliding contact. This can be achieved by conveniently making the components of the assembly of moulded plastics material. It will also be understood that the nibs 35*a*, 35*b* engage their respective ramped surfaces 34*a*,

34*b* over a discrete and relatively small contact area. This allows the possibility for the profile of the ramped surfaces 34*a*, 34*b* to be configured in an almost infinite variety of different ways in order to suit different requirements.

Here, the ramped surfaces 34*a*, 34*b* on the driving elements 30*a*, 30*b* are configured such that pivotal movement of the lid and/or seat members 12, 13 in their lowering direction will cause linear movement of the end caps 21*a*, 21*b* in a direction towards each other. The effect of this will be to cause axial compression of the damper 17. Axial compression of the damper 17 will in turn create a resistive damping force which is transmitted back through the drive mechanism to the lid and/or seat members 12, 13 and hence attenuate their closing movement.

It will be noted that the damper 17 will be actuated to provide a damped resistive force to the closing movement of the lid or seat members 12, 13 moving singly, as well as to the closing movement of the two members moving together.

The effect of the force of gravity acting on the lid and seat members 12, 13 will not be constant throughout their pivotal movement. In fact, the force will increase progressively as the lid/seat members 12, 13 pivot from their initial generally upright position towards their lower, generally horizontal position. Ideally, the assembly will be tailored to accommodate this variable force. This can be achieved in the assembly here by suitably configuring the profile of the ramped surfaces 34*a*, 34*b* on the driving elements 30*a*, 30*b*. The amount of resistive damping force that the damper 17 generates is basically proportional to the rate of its axial compression: a higher rate of compression produces a larger damped resistive force and vice versa. If the ramped surfaces 34*a*, 34*b* on the driving elements 30*a*, 30*b* follow a plain helical pattern, this will produce a constant amount of linear displacement of the end caps 21*a*, 21*b* per degree of rotation of the driving elements, i.e. a constant rate of axial compression of the damper 17. If the ramped surfaces 34*a*, 34*b* are instead configured to have an increasingly steep profile beyond helical, then this will cause an increasingly rapid rate of axial compression of the damper 17 per degree of rotation of the driving elements 30*a*, 30*b*. The damped resistive force from the assembly can thus be matched to the variable load from the lid/seat members.

The profiling of the ramped surfaces 34*a*, 34*b* can also be configured to determine the precise range of rotational movement of the lid and seat members 12, 13 during which the damper is to provide damped resistance. For example, it might typically be preferred for there to be no damping force during the first 20*o* of the initial rotational movement of the lid and seat members from their upright position towards their lower position. In that case, each ramped surface 34*a*, 34*b* would be configured with an initial section of its profile lying normal to the pivotal axis 20.

The assembly will normally be designed not to impart any damping force to oppose the opening movement of the seat and lid members upwardly from their lower position. For this purpose, the damper may incorporate a valve mechanism in its piston.

It is not essential for the damper to incorporate a spring: an alternative mechanism could be provided for urging the damper towards its extended position. In one example, the free end of the piston rod could be attached to the surface against which it is arranged to act.

In the assembly described above, although the damper is conveniently located within it, there is nevertheless enough room to fit in a unit with a sizeable damping capacity. If necessary, however, the damper could be augmented by one or more additional dampers mounted in parallel.

In a modified arrangement, the assembly could be designed to accommodate two separate dampers aligned along the pivotal axis. In that case, the dampers could be arranged to react against a common fixed point in the assembly, for example in the form of a central wall within the block. Each of the dampers would then separately serve a respective one of the seat and lid members. An advantage of this arrangement would be that the members will be able to experience the same level of damping force regardless of whether they are lowered separately or together. In the arrangement with just a single damper, the effect of the damping force will be less if the seat and lid members are lowered together than if they are lowered individually.

FIG. 4 shows a second form of damped hinge assembly, again for use on a lavatory seat 11 comprising a lid member 12 and a seat member 13, both of which are pivotally mounted onto a lavatory 14. In this case, the pivotal mounting of the lid and seat members 12, 13 comprises a pair of separate mounting units 50*a*, 50*b*. The mounting units 50*a*, 50*b* are anchored to the lavatory 14 by threaded fasteners 16 located in the usual spaced apart mounting holes.

The mounting units 50*a*, 50*b* are essentially identical, and each comprises a block 51*a*, 51*b* (shown partly cut away) which is effectively fixed to the lavatory 14. In each block 51*a*, 51*b*, there is mounted a hinge damper unit 52. As will be explained in more detail, the pair of hinge damper units 52 together provide a dual function: firstly, they provide a pivotal mounting for the lid and seat elements 12, 13, and, secondly, they provide a resistive damping force to their closing movement.

The construction of each hinge damper unit 52 is seen in more detail in FIGS. 5 and 6 and consists of a housing 53, a damper 54 and a drive cap 55. At one end the housing 53 has an externally splined section 56 by which it can be mounted to the block 51*a*, 51*b*: this holds the housing non-rotatably fixed to the block. At its other end the housing 53 has a plain cylindrical surface 57: this acts as a spindle for the pivotal mounting of one of the lid and seat elements 12, 13.

The housing 53 is closed off at one end by an end wall 58. At the other end of the housing 53, the drive cap 55 is mounted. The drive cap 55 is mounted to be rotatable relative to the housing 53, but is flanged (as at 59) to be retained axially in position relative to the housing. On its external surface, the drive cap 55 is provided with splines 60. The drive cap 55 acts as a pivotal mounting for the other of the lid and seat elements 12, 13. The splines 60 on the drive cap 55 ensure that the connection between the two is non-rotatable, ie when the lid or seat element to which it is connected is pivoted, it will cause a corresponding rotational movement of the drive cap 55. On its interior, the drive cap 55 is provided with a pair of diametrically opposed keyways 61.

The damper 54 here is again of the linear piston and cylinder variety, with a piston (not shown) connected to a piston rod 62 and acting within a cylinder 63 on a damping medium such as silicone, and with a spring (not shown) biassing the piston rod towards its extended position. The free end of the piston rod 62 is arranged to abut against the end wall 58 of the housing 53. The spring is again not essential here, and the piston rod 62 could be attached to the end wall 58 of the housing 53.

The cylinder 63 has a specially shaped external profile. At its end opposite its piston rod 62, it has a pair of diametrically opposed keys 64. The keys 64 are designed to engage the keyways 61 of the drive cap 55. This ensures that the cylinder 63 and drive cap 55 will rotate together, whilst allowing relative axial movement between the two.

The cylinder 63 also comprises a pair of diametrically opposed ribs 65, each extending around its outer surface. Each rib 65 is shaped with a camming profile that is designed to engage with a respective one of a pair of diametrically opposed lugs 66 provided on the interior of the housing 53. The ribs 65 and their respective lugs 66 cooperate together in the manner of a cam and cam follower and act to convert rotational movement of the drive cap 55 into axial displacement of the cylinder 63. With the piston rod 62 abutting against the end wall 58 of the housing 53, axial displacement of the cylinder 63 will cause extension or contraction of the damper 54.

Preferably, the damper 54 will be designed to produce a damped restrictive force on contraction, but no resistance on extension (it may incorporate a valve in its piston for this purpose). Thus the assembly can be set up to provide a damped resistive force to the pivotal closing movement of the lid/seat element, without resistance to its opening movement.

The assembly is arranged so that the hinge damper unit in one of the blocks will provide damping for one of the lid and seat elements, whilst the hinge damper unit in the other block will provide damping for the other element. It will be noted that this conveniently does not require the hinge damper unit to be separately handed: the same device can be used in each case.

As with the form of assembly previously described, this form of assembly can be designed to produce a tailored damped resistive force. In particular, the nature of the rib/lug engagement between the cylinder 63 and housing 53 is designed to allow for the possibility of varying the camming profile. With a strictly helical camming profile, for example, this would produce a constant amount of axial displacement of the cylinder 63 per degree of rotation of the drive cap 55. If the camming profile is designed to increase progressively from the helical, then this would produce an increasing amount of axial displacement per degree of rotation. Also, the starting point of the camming profile could be adjusted in order to delay the onset of the axial displacement until after a certain amount of rotation. Other variations of the camming profile are of course possible to allow a wide range of different solutions tailored to suit different applications.

The motion converting mechanism described above could be embodied in a number of different ways. For example, rather than using the form of external ribs extending out from the surface of the cylinder 63, the camming profile could instead be provided in the form of grooves or cut-aways formed in the surface of the cylinder. An example of this alternative form is seen in FIG. 7. Here, a pair of diametrically opposed rebates 70 is formed in the outer surface of the cylinder 63. The housing 53 here is formed with a pair of diametrically opposed lugs 71 which extend into its interior and engage complementarily with respective rebates. By carefully profiling the shape of the rebates 70, the arrangement can be designed to produce the desired amount of movement conversion to produce damped resistance tailored to suit movement of the lid/seat elements.

It will be understood that the various cam and cam follower formations described above which act as the movement converting mechanisms could equally well be provided the other way round on their respective components. For example, the profiled rebates of the FIG. 7 example could be provided on the housing, rather than on the cylinder, with the lugs in that case being provided on the cylinder, rather than on the housing.

It will be appreciated that the assemblies described above are suitable for use in other applications, including for example in vertical alignment for hanging doors. In that case, the assemblies could be used in the manner of a rising butt hinge and provide damping to the movement of the door as it falls and closes under the force of gravity. Alternatively, the assemblies could be used in the manner of a normal swinging hinge and provide a damped resistive force to the closing movement of the door.

The invention claimed is:

1. A damped hinge assembly for mounting a first member for pivotal movement relative to a second member about a hinge axis of rotation over a range of pivotal movement, the assembly comprising a linear piston and cylinder damper including a piston rod acting within a cylinder, means for mounting the linear piston and cylinder damper with a longitudinal axis parallel to the hinge axis, and camming means for converting pivotal movement of the first member in at least one direction of rotation into relative axial displacement between the piston rod and the cylinder of the linear piston and cylinder damper and for producing a varying amount of relative axial displacement between the piston rod and the cylinder of the linear piston and cylinder damper per degree of pivotal movement of the first member to cause the linear piston and cylinder damper to produce a damped resistive force to counter said pivotal movement of the first member over at least part of the range of pivotal movement, wherein the longitudinal axis of the linear piston and cylinder damper is arranged to be coincident with the hinge axis, wherein the camming means comprises a cam adapted to be indirectly mounted to one of the first and second members and a cam follower adapted to be indirectly mounted to another of the first and second members, wherein the cam comprises a pair of diametrically opposed camming surfaces, and wherein the cam follower comprises a pair of diametrically opposed nibs, with each nib engaging a respective camming surface.

2. A damped hinge assembly as claimed in claim 1 wherein the camming means produces intermittent or non-continuous axial displacement of the linear piston and cylinder damper over the range of pivotal movement of the first member.

3. A damped hinge assembly as claimed in claim 1 wherein one of the cam and the cam follower has rotational movement about the hinge axis whilst another of the cam and the cam follower is prevented from rotating.

4. A damped hinge assembly as claimed in claim 3 wherein each camming surface comprises a circumferentially extending camming surface on an axial face of a first driver element.

5. A damped hinge assembly as claimed in claim 4 wherein each nib is on an axial face of a second driver element.

6. A damped hinge assembly as claimed in claim 5 wherein one of the first and second driver elements is connected to the first member for rotation therewith, whilst another of the first and second driver elements is held non-rotatably.

7. A damped hinge assembly as claimed in claim 6 wherein the non-rotatably held driver element is capable of axial movement parallel to the hinge axis.

8. A damped hinge assembly as claimed in claim 1 wherein the assembly is attached to the second member by two spaced apart fasteners, with the linear piston and cylinder damper located in a space therebetween.

9. A damped hinge assembly as claimed in claim 1 further comprising a third member for pivotal movement relative to the second member, with the linear piston and cylinder damper arranged to produce a damped resistive force to counter pivotal movement of the third member in at least said one direction of rotation.

10. A damped hinge assembly as claimed in claim 9 further comprising a third driver element associated with the third member.

11. A damped hinge assembly as claimed in claim 10 wherein the first and third driver elements are arranged to act on the linear piston and cylinder damper in opposite directions along the hinge axis.

12. A damped hinge assembly as claimed in claim 9 wherein the linear piston and cylinder damper is a first linear compression damper.

13. A damped hinge assembly as claimed in claim 12 further comprising a second linear compression damper arranged parallel to the longitudinal axis of the first linear compression damper.

14. A damped hinge assembly as claimed in claim 13 wherein the second linear compression damper is arranged with a longitudinal axis coincident with the longitudinal axis of the first linear compression damper.

15. A damped hinge assembly as claimed in claim 14 wherein each of the first and second linear compression dampers react against a fixed point and provide damping for a respective one of the second and third members.

16. A damped hinge assembly as claimed in claim 15 wherein the first and second linear compression dampers react against a common fixed point within the assembly.

17. A damped hinge assembly as claimed in claim 1 wherein one of the cam and the cam follower is provided on the linear piston and cylinder damper itself.

18. A damped hinge assembly as claimed in claim 1 wherein the pair of diametrically opposed camming surfaces are in a form of a pair of rebates in an outer surface of the linear piston and cylinder damper.

19. A damped hinge assembly for mounting a first member for pivotal movement relative to a second member about a hinge axis of rotation over a range of pivotal movement, the assembly comprising a linear damper, means for mounting the linear damper with a longitudinal axis parallel to the hinge axis, and camming means for converting pivotal movement of the first member in at least one direction of rotation into axial displacement of the linear damper and for producing a varying amount of axial displacement of the linear damper per degree of pivotal movement of the first member to cause the linear damper to produce a damped resistive force to counter said pivotal movement of the first member over at least part of the range of pivotal movement, wherein the longitudinal axis of the linear damper is arranged to be coincident with the hinge axis, wherein the camming means comprises a cam adapted to be indirectly mounted to one of the first and second members and a cam follower adapted to be indirectly mounted to another of the first and second members, wherein the cam comprises a pair of diametrically opposed camming surfaces, and wherein the cam follower comprises a pair of diametrically opposed nibs, with each nib engaging a respective camming surface, and wherein the pair of diametrically opposed camming surfaces are in a form of a pair of ribs extending around an outer surface of the linear damper.

20. A damped hinge assembly for mounting a first member for pivotal movement relative to a second member about a hinge axis of rotation over a range of pivotal movement, the assembly comprising a linear damper, means for mounting the linear damper with a longitudinal axis parallel to the hinge axis, and camming means for converting pivotal movement of the first member in at least one direction of rotation into axial displacement of the linear damper and for producing a varying amount of axial displacement of the linear damper per degree of pivotal movement of the first member to cause the linear damper to produce a damped resistive force to counter said pivotal movement of the first member over at least part of the range of pivotal movement, wherein the longitudinal axis of the linear damper is arranged to be coincident with the hinge axis, wherein the camming means comprises a cam adapted to be indirectly mounted to one of the first and second members and a cam follower adapted to be indirectly mounted to another of the first and second members, wherein the cam comprises a pair of diametrically opposed camming surfaces, and wherein the cam follower comprises a pair of diametrically opposed nibs, with each nib engaging a respective camming surface, and wherein the linear damper is mounted within a housing and the pair of diametrically opposed nibs are formed on said housing to extend into an interior of the housing.

21. A damped hinge assembly as claimed in claim 20 wherein the housing is held in a fixed position rotationally and axially with respect to the hinge axis.

22. A damped hinge assembly as claimed in claim 21 wherein the housing has a drive cap mounted thereon, with the drive cap having freedom to rotate relative to the housing, but not to move axially relative thereto.

23. A damped hinge assembly as claimed in claim 22 wherein the linear damper is mounted partially within said drive cap, with the drive cap having freedom to move axially relative thereto, but constrained to rotate therewith.

* * * * *